United States Patent [19]

Collins

[11] 4,275,620

[45] Jun. 30, 1981

[54] TORQUE ARM FOR USE WITH A TORQUE WRENCH

[76] Inventor: Bobby W. V. Collins, P.O. Box 15034, Baton Rouge, La. 70895

[21] Appl. No.: 40,545

[22] Filed: May 21, 1979

[51] Int. Cl.[3] ..... B25B 13/46
[52] U.S. Cl. ..... 81/57.39; 81/125.1
[58] Field of Search ..... 81/57.39, 125.1

[56] References Cited

U.S. PATENT DOCUMENTS

| | | | |
|---|---|---|---|
| 1,261,565 | 4/1918 | Leitner | 81/125.1 |
| 2,662,437 | 12/1953 | Reynolds | 81/125.1 |

*Primary Examiner*—James L. Jones, Jr.
*Attorney, Agent, or Firm*—Roy, Kiesel, Patterson & McKay

[57] ABSTRACT

A linking arm having a bolt or nut receiving unit offset at one end of an arm member whose opposite end is attachable to a torque wrench for tightening or loosening the bolt or nut.

3 Claims, 4 Drawing Figures

TORQUE ARM FOR USE WITH A TORQUE WRENCH

BACKGROUND OF THE INVENTION

1. Field of the Invention

The present invention relates generally to torque wrenches and, more particularly, to a torque arm design for use with a torque wrench.

2. Prior Art

The development of torque wrenches, particularly hydraulic torque wrenches, has risen with the ever increasing need to service heavy industrial equipment wherein a high, controllable torque is needed to loosen the large threaded bolts and nuts used in such equipment.

One problem which has continued to limit the use of hydraulic torque wrenches has been the slowness of their operation. Another problem is that the bulkiness of the hydraulic torque wrenches do not allow removal of some nuts and bolts which may be set close to another part of the equipment being serviced. Various design arrangements, such as those described in the following United States patents, have been devised to reduce these problems: Sergan U.S. Pat. No. 3,683,686 entitled "Mechanical Torque Wrench and a Hydraulic Readout therefor", issued Aug. 15, 1972; Biach U.S. Pat. No. 3,745,858, entitled "Torquing Device", issued July 17, 1973; Keller U.S. Pat. No. 3,930,776, entitled "Hydraulic Wrench", issued Jan. 6, 1976; Orban U.S. Pat. No. 3,995,828, entitled "Bolt Tensioning Apparatus", issued Dec. 7, 1976; Junkers U.S. Pat. No. 4,027,561, entitled "Hydraulic Wrench", issued June 7, 1977; Bickford, et al. U.S. Pat. No. 4,060,137, entitled "Torque Wrench", issued Nov. 29, 1977; Wilmeth et al. U.S. Pat. No. 4,091,890, entitled "Very High Torque Ratchet Wrench", issued May 30, 1978.

SUMMARY OF THE INVENTION

Therefore, one object of this invention is to provide an improved linking arm design for use on a hydraulic torque wrench.

Another object of this invention is to provide a hydraulic torque wrench that can be attached to nuts and bolts set close to other parts of the equipment being serviced.

Still another object of this invention is to provide a hydraulic wrench that can quickly remove the nuts and bolts from the equipment being serviced.

Other objects and advantages of this invention shall become apparent from the ensuing descriptions of the invention.

Accordingly, for use with a torque wrench, a torque arm comprising a sprocket head mounted on one end of a metal bar and a nut receiving head mounted off center of the opposite end of the metal bar wherein the sprocket head is shaped to attach to the drive means of the hydraulic torque wrench and the nut receiving head having a cavity of cross-sections similar to the nut but slightly larger so that the nut fits in the cavity.

PREFERRED EMBODIMENTS OF THE INVENTION

Figure 1:
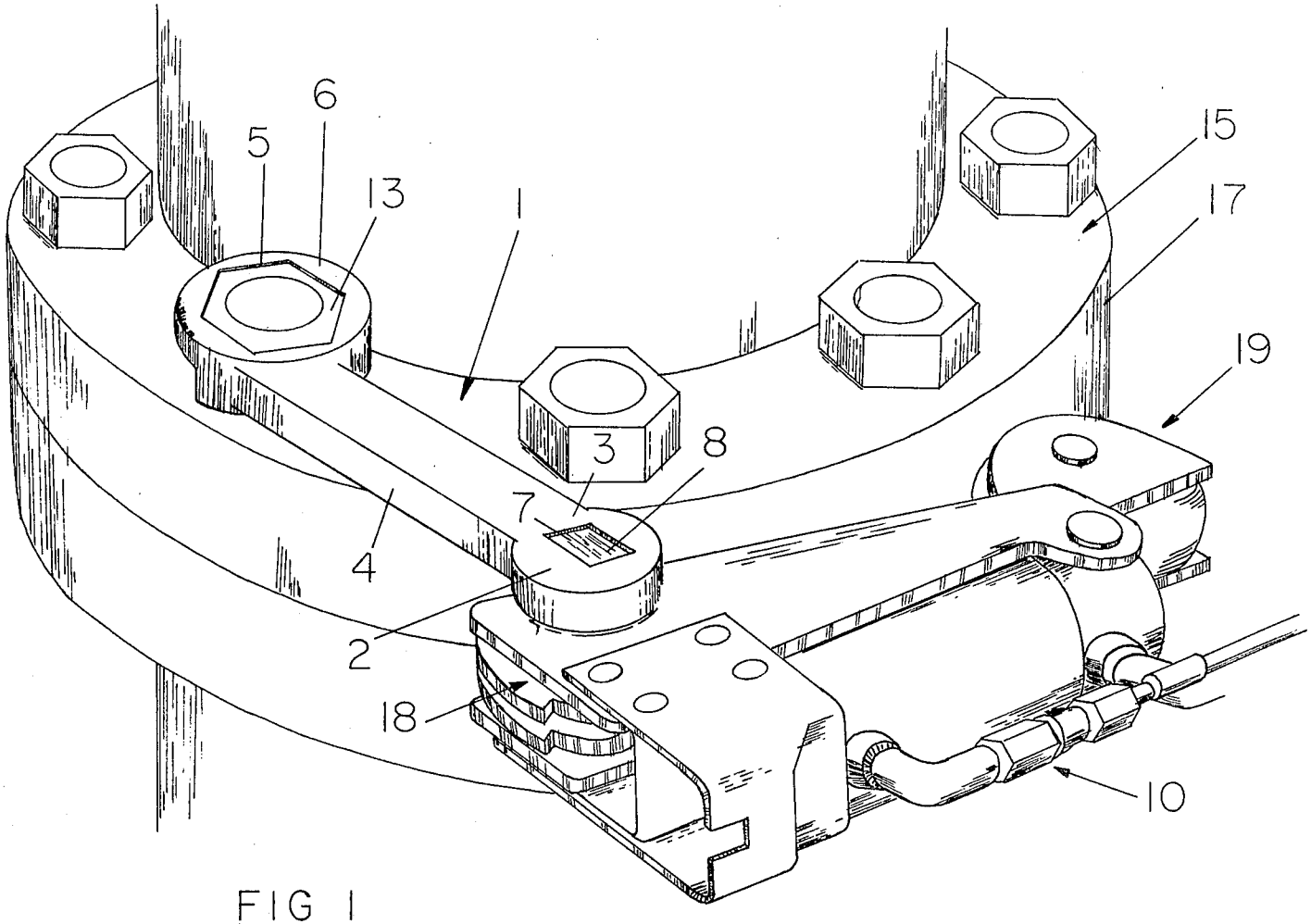
FIG. 1 is a cutaway three-dimensional view of one embodiment of the torque arm attached to a hydraulic torque wrench in place on a large flange connection.
Figure 2:
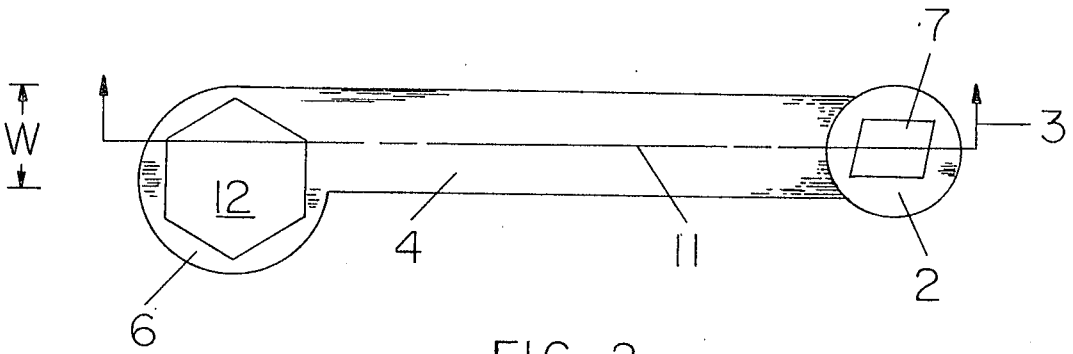
FIG.2 is a top view of the torque arm as seen from lines 2—2 of FIG. 1.
Figure 3:
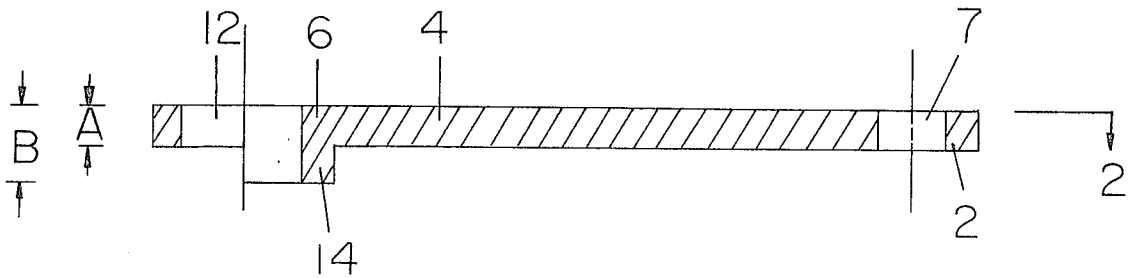
FIG. 3 is a cross-sectional view of the torque arm taken along lines 3—3 of FIG. 1.
Figure 4:
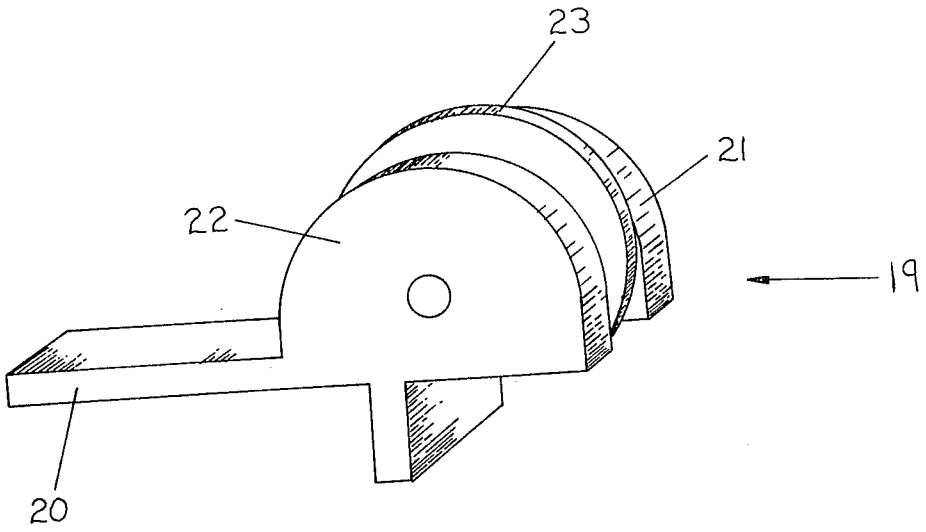
FIG. 4 is a three dimensional view of a preferred embodiment of a roller assembly attachable to a torque wrench utilizing the torque arm of this invention.

Referring now to FIGS. 1-3, torque link, denoted generally by the numeral 1, comprises in general a sprocket head 2 mounted on one end 3 of arm member 4 and a nut receiving head 5 mounted at the opposite end 6.

Socket head 2 is provided with cavity 7 shaped to mate with sprocket 8 of torque wrench 9 (shown here as a hydraulic torque wrench although other types of industrial torque wrenches could be used) so that sprocket 8 is turned by drive means 10 of wrench 9. Torque arm 1 is also rotated as more fully described below. In a preferred embodiment, the center of cavity 7 is aligned with the center line 11 of arm member 4. Arm member 4 is preferably a metal bar having a width and depth of sufficient width to remain rigid during use.

Nut receiving head 5 is provided with an opening 12 having a cross-sectional shape identical to that of nut 13 so as to lockingly mate with nut 13 when head 5 is fitted about nut 13. Head 5 is attached to arm member 4 so that the center of opening 12 is not aligned with center line 11. The amount of offset is limited by the structural strength needed in arm 1. This need varies with the size nut being removed. However, it is preferred that the center of head 5 be offset a distance greater than one-half the width "W" of the arm member 4. In this manner, an additional 20°-60° of revolution of nut 13 can be achieved with each stroke of torque wrench 9, thus, substantially reducing the time. Furthermore, the use of torque link 1 results in only having to position head 5 about nut 13 and not having to have room for torque wrench 9 to fit on top of nut 13 as required by the prior art. Another substantial benefit of torque arm 1 is the greater torquing force achieved during the tightening or loosening stroke of the torque wrench 9, particularly the beginning of the stroke. This allows the use of a torque wrench in many additional industrial applications.

In a preferred embodiment, head 5 is provided with a side wall 14 that has more depth at the point where it is attached to arm member 4 that at its tip. More preferably, the depth "A" is one-half or less of the depth "B". In this embodiment, the optimum bulkiness of head 5 is achieved while still maintaining the strength needed in head 5 during torquing of nut B.

In another preferred embodiment, torque wrench 9 is provided with a roller assembly 19 attached to the rear of torque wrench 9. Roller assembly 19 comprises a brace structure 20 fixedly attached to torque wrench 9 and has parallel shoulder members 21, 22 between which is rotatably mounted roller 23 whose surface 24 will extend beyond shoulder members 21, 22 so that it can contact flange side wall 17 during the torquing stroke. Through this embodiment, greater torque forces can be achieved by the reduction of friction that normally results when the torque wrench end pushes against flange side wall 17 during the torquing stroke.

In operation, sprocket head 2 is attached to sprocket 8 and head 5 is positioned over nut 13, while, at the same time, torque wrench 9 is placed on flange 15 so that torque arm 4 and torque wrench 9 form the greatest possible angle between them when torque wrench 9 is against flange side wall 17, as shown. Hydraulic pressure is then applied to drive means 10, which moves against ratcheting assembly 18, forcing sprocket 8 to turn. This forces torque arm 1 to turn and, of course, nut 5.

There are, of course, many obvious alternate embodiments and modifications to this invention which are intended to be included within the scope of this invention as defined by the following claims.

What I claim is:

1. A torque arm attachable to a drive axle of a torque wrench and fittable about a nut or bolt head to rotate same which comprises:

(a) an arm member having a straight center line and provided with a flat underside, (b) a sprocket head attached at one end of the arm member and having a cavity extending throughout perpendicular to the arm member under side, and shaped to matingly receive the torque wrench drive axle, the center of the cavity being aligned with the arm member center line and the bottom of the sprocket head being in the same plane formed by the arm member underside, (c) a head member attached at the opposite end of the arm member and having an opening extending throughout perpendicular to the arm member under side and shaped to matingly receive the nut or bolt head, the center of the opening being offset from the arm member center line, and a portion of the bottom of the head member extending below the plane formed by the arm member under side.

2. A torque arm according to claim 1 the head member has side walls with greater depth adjacent to the arm member.

3. A torque arm according to claim 1 wherein the center of the head member opening is offset from the arm member center line a distance of at least one-half the width of the arm member.

* * * * *